US011189143B2

(12) United States Patent
Ribalda Galvez et al.

(10) Patent No.: US 11,189,143 B2
(45) Date of Patent: Nov. 30, 2021

(54) ASPIRATION SMOKE DETECTION SYSTEM

(71) Applicant: Carrier Corporation, Palm Beach Gardens, FL (US)

(72) Inventors: Miquel Ribalda Galvez, Barcelona (ES); Jose Manuel Munuera Garcia, Barcelona (ES); Ricard Burriel Maurel, Barcelona (ES)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/103,209

(22) Filed: Nov. 24, 2020

(65) Prior Publication Data

US 2021/0166540 A1 Jun. 3, 2021

(30) Foreign Application Priority Data

Nov. 29, 2019 (EP) ..... 19383064

(51) Int. Cl.
*G08B 17/00* (2006.01)
*G08B 17/10* (2006.01)
*G08B 21/18* (2006.01)

(52) U.S. Cl.
CPC ..... *G08B 17/10* (2013.01); *G08B 21/182* (2013.01)

(58) Field of Classification Search
CPC ..... G08B 17/10; G08B 21/182
USPC ..... 340/628
See application file for complete search history.

(56) References Cited

U.S. PATENT DOCUMENTS 6,052,058 A * 4/2000 Knox ..... G08B 17/107 340/607
6,285,291 B1 * 9/2001 Knox ..... G08B 17/107 340/634
10,520,133 B1 * 12/2019 Levine ..... G08B 17/10
2004/0145484 A1 7/2004 Wagner et al.
2007/0008157 A1 * 1/2007 Siemens ..... G08B 17/10 340/577
2007/0103325 A1 * 5/2007 Wagner ..... G08B 17/113 340/628
2007/0176783 A1 * 8/2007 Knox ..... G08B 17/10 340/607
2008/0258924 A1 * 10/2008 Moss ..... G08B 25/14 340/577

(Continued)

FOREIGN PATENT DOCUMENTS

EP 2840560 A1 2/2015

OTHER PUBLICATIONS

European Search Report for Application No. EP 19383064.3, dated May 12, 2020, 8 pages.

*Primary Examiner* — Ojiako K Nwugo
(74) *Attorney, Agent, or Firm* — Cantor Colburn LLP

(57) ABSTRACT

An aspiration smoke detection system for detecting the presence of a fire within a region of interest. The aspiration smoke detection system includes a smoke detection unit for detecting the presence of smoke particles suspended in air; and one or more local sensors located remotely from the smoke detection unit for measuring a property of air from the region of interest that is drawn into the aspiration smoke detection system. An inlet piece includes a sensor for use with the aspiration smoke detection system is also provided. A method of detecting a fire using the aspiration smoke detection system and a method of locating a fire using the aspiration smoke detection system are also provided.

19 Claims, 1 Drawing Sheet

(56) References Cited

U.S. PATENT DOCUMENTS

| | | | | |
|---|---|---|---|---|
| 2012/0319853 | A1* | 12/2012 | Goulet | G08B 17/10 340/632 |
| 2013/0208281 | A1* | 8/2013 | Masumoto | G08B 17/107 356/438 |
| 2015/0253165 | A1* | 9/2015 | Ajay | G08B 17/10 73/28.01 |
| 2015/0310717 | A1* | 10/2015 | Al-Farra | G08B 17/12 340/628 |

* cited by examiner

ASPIRATION SMOKE DETECTION SYSTEM

FOREIGN PRIORITY

This application claims priority to European Patent Application No. 19383064.3, filed Nov. 29, 2019, and all the benefits accruing therefrom under 35 U.S.C. § 119, the contents of which in its entirety are herein incorporated by reference.

TECHNICAL FIELD OF INVENTION

The present invention relates to an aspiration smoke detection system, an inlet piece for the aspiration smoke detection system, a method for detecting a fire using the aspiration smoke detection system, and/or a method of locating a fire using the aspiration smoke detection system.

BACKGROUND OF THE INVENTION

An aspiration smoke detection system is a known type of fire detection means. Such systems have a central smoke detection unit. The system is arranged to draw air from a region to be monitored through a series of sampling pipes. The sampling pipes have a plurality of inlets for allowing air (and smoke particles, if present) into the system from a plurality of locations within the region being monitored. One or more fans are often provided in the system to actively draw in air into the system and move it towards the central detection unit. The central detection unit comprises a highly sensitive smoke detection device for detecting the presence of smoke particles suspended within the air, indicating the presence of a fire somewhere within the monitored region.

Their high sensitivity means that aspiration smoke detection systems are ideally suited for use in environments where fire detection at an early stage is required (when the smoke concentration in the sample may be very low), for example in facilities storing highly flammable liquids and gasses, clean rooms and electrical rooms. Also, due to the sensitivity of the central detection unit, aspiration smoke detection systems are able to detect smoke emanating from slowly developing smouldering fires during the early stages of such fires. Smouldering fires produce low levels of smoke and result in small rises in temperature, at least initially. As a result, this type of fire can remain undetected by less sensitive smoke or fire detectors for some time before sufficient smoke or heat is produced for it to be detected.

Due to the provision of a single centralised detection unit, rather than multiple local detection units, the speed at which aspiration smoke detection systems can detect the presence of smoke within a region being monitored is dependent on size of the region and the length of the pipes through which the air is passed to the detection unit. That is to say, the time taken to detect the presence of smoke in the region is limited by the time it takes for the air to be transported through the pipes to the centralised detector. This is known as the transportation time.

Smoke detectors are required to meet global safety certification standards, for example those in UL 268, 7th edition. This standard requires smoke detectors to be able to detect the presence of a quickly developing exothermic fire within 70 seconds from the fire starting. Such a fire, for example caused by an explosion or flaming polyurethane, releases a large quantity of heat and smoke over a short period of time. In order to meet this standard it has been known to limit the transportation times in aspiration smoke detectors by limiting the length of the sampling pipes.

Hence, this standard has been seen to limit the size of a region that can be monitored by a single aspiration smoke detector.

It has also been found difficult to provide aspiration smoke detection systems that can identify the location of a fire within a monitored region. The ability to identify the location of a fire is known as addressability. Since the air drawn into the system through the plurality of inlets is combined and mixed in the sampling pipes before reaching the centralised detection unit, it is not possible for the detection unit to determine the origin of any sensed smoke particles. A number of attempts have been made to provide an aspiration smoke detection system with addressability, but none have been found to provide satisfactory results.

SUMMARY OF THE INVENTION

Viewed from a first aspect, the present invention provides an aspiration smoke detection system for detecting the presence of a fire within a region of interest, the system comprising: a smoke detection unit for detecting the presence of smoke particles suspended in air; and one or more local sensors located remotely from the smoke detection unit for measuring a property of air from the region of interest that is drawn into the aspiration smoke detection system; wherein the aspiration smoke detection system is configured to use the one or more local sensors to detect quick developing fires before a sample of air reaches the smoke detection unit.

By providing an aspiration smoke detection unit with both a smoke detection unit and one or more local sensors, the system is able to detect certain fires more quickly, and may allow for determination of the location of a fire more quickly. The local sensors allow early response on quick developing fires and may allow the provision of an aspiration smoke detection system with addressability.

The local sensors can be used to detect a quickly developing fire before a sample from the fire reaches the central smoke detection unit, hence decreasing the detection time. That is to say, quick developing fires can be detected by a local sensor in a time that is shorter than the time it takes for a sample from the location of the fire to reach the smoke detection unit. Advantageously, the system allows for quick developing fires and/or explosions etc. to be detected more quickly compared to a system without local sensors.

Some fires, such as slow developing fires, may, at least at the start of the fire, only produce a small amount of smoke and/or heat. This may produce enough smoke to be detected by the smoke detection unit but not enough smoke or heat to be detected by the local sensor. This may be because the smoke detection unit is more sensitive than the one or more local sensors. However, once the smoke detection unit has detected the presence of smoke which indicates the presence of a fire in the region of interest, data from the local sensors may be analysed. This may be done to determine whether any of the data from them suggests that the fire might be near a particular local sensor, even though the in data from the local sensor was not sufficient itself to allow the fire to be detected.

The smoke detection unit may be more sensitive than the one or more local sensors.

The region of interest may be the space being monitored for fires by the aspiration smoke detection system. The region of interest may for example be or comprise a building and/or one or more rooms within a building.

The aspiration smoke detection system may be arranged to pass air (i.e. aspirate air) from the region of interest to the smoke detection unit via one of the one or more local sensors. Hence, at least one of the local sensors may be positioned in a flow path of the air between the region of interest and the smoke detection unit.

The one or more local sensors may each constantly or periodically monitor the air drawn into the aspiration smoke detection system from the region of interest. That is to say, the one or more local sensors may constantly or periodically measure a property of the air from the region of interest that is drawn into the aspiration smoke detection system.

The aspiration smoke detection system may comprise one or more inlets for, in use, passing air from the region of interest into the smoke detection unit. The one or more or each inlet may comprise a capillary.

The aspiration smoke detection system may comprise one or more sampling pipes extending from the smoke detection unit. Each of the one or more sampling pipes may be fluidly connected to the smoke detection unit. Each of the one or more sampling pipes may have one or more inlets for admitting air into the sampling pipe from the region of interest. The one or more sampling pipes may be for transporting air from the region of interest to the smoke detection unit.

The smoke detection unit may be more remote from the region of interest than at least one or more, or all of the one or more local sensors. The one or more local sensors may be located within or near the region of interest. The smoke detection unit may be located outside and/or remote from the region of interest.

The smoke detection unit may be referred to as a central smoke detection unit. This does not mean that the smoke detection unit is necessarily at any central location but instead refers to the fact that the smoke detection unit may receive samples from a number of locations to one common 'central' location. The smoke detection system may be referred to as a common smoke detection unit and/or a remote smoke detection unit.

The one or more local sensors may be associated with the one or more sampling pipes.

The one or more local sensors may each be located on, near or in one of the inlets. For example, each inlet may have an associated local sensor. Each inlet may comprise a capillary and a local sensor may be provided within or near the capillary. Thus, a sensing capilar may be provided.

The one or more local sensors may each be located at a position that allows sensing of the property of air drawn into the aspiration smoke detection system through an inlet before the air mixes with air from other inlets.

One or more of the inlets may comprise an inlet piece. The one or more local sensors may be located within the inlet piece.

The aspiration smoke detection system may be arranged so that air is drawn in from the region of interest through the one or more inlet pieces.

The inlet pieces each comprising a local sensor may be a separate, non-integral and/or detachable part from the rest of the aspiration smoke detection system. For example, the inlet pieces each comprising a local sensor may be a separate, non-integral and/or detachable part from the one or more sampling pipes.

This may allow removal of the inlet piece, and hence associated local sensor. This may allow repair, replacement and/or charging of the local sensor without having to remove or disable the aspiration smoke detection system, and in particular without having to remove or disable the smoke detection unit.

The inlet pieces may be separately supplied parts to the rest of the components of the aspiration smoke detection system. These inlet pieces with a local sensor may be retrofit to an existing aspiration smoke detection system.

In a second aspect, that is not presently claimed, the present invention may provide an inlet piece for an aspiration smoke detection system for detecting the presence of a fire within a region of interest, wherein the inlet piece is for being installed in the region of interest, and wherein the inlet piece comprises a sensor for measuring a property of air that in use is drawn into the inlet piece.

The inlet piece may comprise an inlet pipe comprising a first end and a second end. The inlet pipe may comprise an inlet port at the first end for admitting air into the inlet pipe. The inlet pipe may comprise an outlet port at the second end for enabling the inlet pipe to be fluidly connected to the aspiration smoke detection system. The sensor, i.e. local sensor described above, may be arranged/located within the inlet pipe for measuring a property of air within the inlet piece and/or on the inlet piece for measuring a property of air entering the inlet piece. The sensor may be located near the inlet port. This may for example, be within the inlet pipe and towards or at the inlet port (e.g. closer to the inlet port than the outlet port).

Each inlet piece may provide one of the one or more inlets of the aspiration smoke detection system.

The following description may be applicable to both the aspiration smoke detection system of the first aspect and the inlet piece of the second aspect.

The local sensor(s) may be for measuring a property of air that may be indicative of a fire, e.g. a fire in the region of interest.

The local sensor(s) may each comprise a smoke detector. Thus, the property sensed by the local sensor(s) may be the composition of the air at the local sensor. The local sensor(s) may be for detecting the presence of smoke particles suspended in air. In this case, the required concentration of smoke particles in the air for the local sensor to detect the presence of a fire may be greater than the required concentration of smoke particles in the air for the smoke detection unit to detect the presence of a fire. The local sensor(s) may each be or comprise an ionization smoke detector, an optical smoke detector and/or any other type of known smoke detector.

The local sensor(s) may each be or comprise a heat/temperature detector. Thus the local sensor(s) may each be for detecting the temperature of the air at the local sensor and/or the rate of temperature change. The property sensed by the local sensor(s) may be the heat of air and/or change in heat of the air. The local sensor(s) may each be or comprise a rate-of-rise heat detector.

The local sensor(s) may each be or comprise a carbon dioxide sensor. Thus, the property sensed by the local sensor(s) may be the composition of the air at the local sensor. The local sensor(s) may each be for detecting the presence of carbon dioxide in the air.

The local sensor may comprise or be attached to a battery and/or other electronics.

The inlet piece may comprise an attachment part for facilitating connection of the inlet piece to a building structure, such as a ceiling panel. This may for example be one or more flanges extending from the inlet pipe. For example, the inlet piece may comprise a flange at the first end of the inlet pipe for facilitating connection of the inlet piece to a building structure.

The outlet port of each inlet piece may be fluidly connected to one of the one or more inlets of the sampling pipe(s). In other words, each inlet piece may be fluidly connected to a respective inlet of the aspiration smoke detection system.

Each of the one or more inlets may be fluidly connected to the outlet port of an inlet piece by flexible tubing.

The aspiration smoke detection system may comprise one or more fans. The fan(s) may be configured to draw (i.e. aspirate) air (and smoke particles, if present) into the aspiration smoke detection system, i.e. into the smoke detection unit, from the region of interest. The air may be drawn by the fan(s) via the one or more local sensors, via the one or more inlet pieces and/or via the one or more sampling pipes.

The transport time of air from at least one of the inlets to the smoke detection unit may be greater than 70 seconds or greater than 100 seconds. When the one or more local sensors are located on, near or in one of the inlets, this may mean that the transport time of air between at least one of the local sensors and the smoke detection unit is greater than 70 seconds, or greater than 100 seconds.

The distance a sample has to travel between one or more of the inlets and the smoke detection unit may be greater than 50 m, or greater than 100 m, or even greater than 200 m. At least one of the one or more sampling pipes may have a length of greater than 50 m, or greater than 100 m. When the one or more local sensors are located on, near or in one of the inlets, this may mean that the distance a sample has to travel between one or more of the local sensors and the smoke detection unit is greater than 50 m, greater then 100 m, or greater than 200 m.

The greater the distance the larger the region of interest that may be monitored may be. The presence of both a central smoke detection unit and one or more local sensors may be particularly beneficial when the region of interest is large. This is because the time for a sample to enter one of the inlets and then reach the central smoke detection unit may be greater. In this case, the local sensor can be used to detect a quickly developing fire before a sample from the fire reaches the central smoke detection unit, hence decreasing the detection time. Additionally, if the central smoke detector detects a fire, in the case that the system comprises a plurality of local sensors, data from the local sensors can be analysed to determine at which location the fire is most likely to be located. This can be particularly beneficial when the region of interest is large and there may be a large number of inlets from which the sample may have originated.

The aspiration smoke detection system may be arranged so that it can detect quick developing fires (e.g. flaming polyurethane) in less than 70 seconds.

The smoke detection unit may comprise a central smoke detector housed within a sampling chamber. The central smoke detector may be or comprise an optical smoke detector. The central smoke detector may be or comprise a nephelometer.

The system may comprise a controller. The controller may comprise a processor. The controller may be arranged to receive data collected by the smoke detection unit and the one or more local sensors. The controller may be arranged to analyse the data from the smoke detection unit and the one or more local sensors and determine whether the data is indicative of a fire being present. The controller may be arranged to raise an alarm (i.e. output information indicating that a fire may be present in the region of interest, such as an audible and/or visual alarm) if the data is indicative of a fire being present in the region of interest.

The controller may be configured to raise an alarm if the concentration of smoke particles suspended in the air measured by the smoke detection unit is above a predetermined threshold value. The predetermined threshold value may be between 0.15% obs/m (0.05% obs/ft) and 6.5% obs/m (2.0% obs/ft). For example, the predetermined threshold value may be 0.3% obs/m (0.1% obs/ft) or 3.35% obs/m (1.02% obs/ft).

The controller may be configured to raise an alarm if data from one or more of the local sensors measures a property of the air that is indicative of a fire. For example, this may be a rate of raise of the temperature greater than a predetermined rate. The predetermined rate may be between 1° K./minute and 30° K./minute. For example, the predetermined rate may be above 6° K./minute, or above 8° K./minute.

If the data from the smoke detection unit is indicative of a fire being present in the region of interest, the controller may be configured to determine the most likely location of a fire within the region of interest based on data collected by the local sensors. The controller may be arranged to analyse the data from the local sensors to determine whether any of them has detected a change in the measured property of air, e.g. a change in the temperature, a change in the concentration of smoke particles in the air and/or a change in the CO2 level etc. If a plurality of the local sensors has detected a change, the controller may be arranged to determine which of the sensors has detected the greatest change. The location at the local sensor with the greatest change may be assessed first to determine if a fire is present at that location. The controller may determine an order in which locations (e.g. rooms) within the region of interest should be checked based on the data from the local sensors. Whilst the detected change at the local sensors may be very small and hence not sufficient on its own to suggest the presence of a fire, it may still usefully be used as an indication of the most likely location for the fire. Thus, this may potentially allow the fire to be located more quickly.

The present invention may provide a building in which the aspiration smoke detection system of the above described first aspect (including one or more or all of the optional features) is installed. The building may comprise one or more rooms. The region of interest may comprise one or more rooms. At least one local sensor may be provided in each room within the region of interest.

In a third aspect, the present invention may provide a method of detecting a fire within a region of interest using an aspiration smoke detection system, the method comprising: providing the aspiration smoke detection system, wherein the aspiration smoke detector comprises a smoke detection unit and one or more local sensors located remotely from the smoke detection unit for measuring a property of air from the region of interest; passing air from the region of interest to the smoke detection unit via one of the one or more local sensors; using the smoke detection unit to measure a concentration of smoke particles within the air passed to the smoke detection unit; using the one or more local sensors to measure a property of the air that can be used to indicate the presence of a fire; determining if the concentration of smoke particles measured by the smoke detection unit is indicative of a fire within the region of interest; and/or determining if the measured property of air sensed by the one or more local sensors is indicative of a fire within the region of interest; wherein the local sensors are used to measure a property of the air before the air reaches the smoke detection unit in order to detect quick developing fires before the air reaches the smoke detection unit.

By performing both a step of determining if the concentration of smoke particles measured by the smoke detection unit is indicative of a fire within the region of interest and a step of determining if the measured property of air sensed by the one or more local sensors is indicative of a fire within the region of interest, fires may be detected more quickly. This is because quick developing fires can be detected by the one or more local sensors before a sample reaches the smoke detection unit and slow developing fires may be detected by the smoke detection unit before the impact on the environment is great enough to be detected by the local sensors. This is because the smoke detection unit may be more sensitive than the local sensors.

If it is determined that the concentration of smoke particles measured by the smoke detection unit is indicative of a fire within the region of interest, and the aspiration smoke detector comprises a plurality of local sensors, the method may comprise analysing data from a the local sensors to determine the most likely location of the fire in the region of interest.

Thus, in a fourth aspect that is not presently claimed, the present invention may provide a method of detecting the location of a fire within a region of interest using an aspiration smoke detection system, the method comprising: providing the aspiration smoke detection system, wherein the aspiration smoke detector comprises a smoke detection unit and a plurality of local sensors located remotely from the smoke detection unit for measuring a property of air from the region of interest; passing air from the region of interest to the smoke detection unit via one of the one or more local sensors; using the smoke detection unit to measure a concentration of smoke particles within the air passed to the smoke detection unit; using the one or more local sensors to measure a property of the air from the region of interest; determining if the concentration of smoke particles measured by the smoke detection unit is indicative of a fire within the region of interest; and, if it is determined that the concentration of smoke particles measured by the smoke detection unit is indicative of a fire within the region of interest, analysing data from the plurality local sensors to determine the most likely location of the fire in the region of interest.

Detecting the location of a fire within a region of interest may involve analysing the data from the plurality of local sensors to determine whether any of the local sensors have sensed a change in the measured property of air. If one of the local sensors has measured a change in the measured property of air, it may be determined that that local sensor is located at or near the most likely location of a fire. If a plurality of the local sensors have sensed a change in the measured property, the method may comprise determining which local sensor has measured the greatest change in the measured property of air. It may be determined that the local sensor that has sensed the greatest change in the measured property of air is located at or near the most likely location of a fire.

The aspiration smoke detection system of the third or fourth aspect may be the above described aspiration smoke detection system (optionally including one, or more or all of the above described optional features).

The following description may be applicable to the method of the third or the fourth aspect.

The method may comprise issuing an alarm (e.g. a visual and/or audible alert) if it is determined that the concentration of smoke particles measured by the smoke detection unit is indicative of a fire within the region of interest.

It may be determined that the concentration of smoke particles measured by the smoke detection unit is indicative of a fire within the region of interest if the concentration of smoke particles is above a threshold. The threshold may be between 0.15% obs/m (0.05% obs/ft) and 6.5% obs/m (2.0% obs/ft). For example, the threshold may be 0.3% obs/m (0.1% obs/ft) or 3.35% obs/m (1.02% obs/ft).

The method may comprise issuing an alarm (e.g. a visual and/or audible alert) if it is determined that the measured property of air sensed by one or more local sensors is indicative of a fire within the region of interest.

It may be determined that the measured property of air sensed by one or more local sensors is indicative of a fire within the region of interest if there is a change in the measured property above a threshold. If the measured property is a rate of change of temperature, the threshold may be between 1° K./minute and 30° K./minute. For example, the data may be regarded as indicative of a fire if the rate of change is greater than 6° K./minute, or than 8° K./minute.

Passing air from the region of interest to the smoke detection unit may be via an inlet piece (if provided) comprising a local sensor.

The present invention may provide a method of retrofitting one or more local sensors to an existing aspiration smoke detection system. This may for example be an existing aspiration smoke detection system that before the retrofitting does not comprise one or more local sensors. The existing aspiration smoke detection system may be an installed aspiration smoke detection system.

The method of retrofitting one or more local sensors to an existing aspiration smoke detection system may result in an aspiration smoke detection system as described above, optionally including one or more or all of the optional features.

The one or more local sensors may each be provided in an inlet piece for use with the aspiration smoke detection system. The method of retrofitting one or more local sensors to an existing aspiration smoke detection system may comprise retrofitting one or more inlet pieces comprising a sensor for measuring a property of air to an existing aspiration smoke detection system.

BRIEF DESCRIPTION OF THE DRAWINGS

Certain preferred embodiments of the present invention will now be described, by way of example only, with reference to the following drawings, in which.

DETAILED DESCRIPTION

Figure 1:
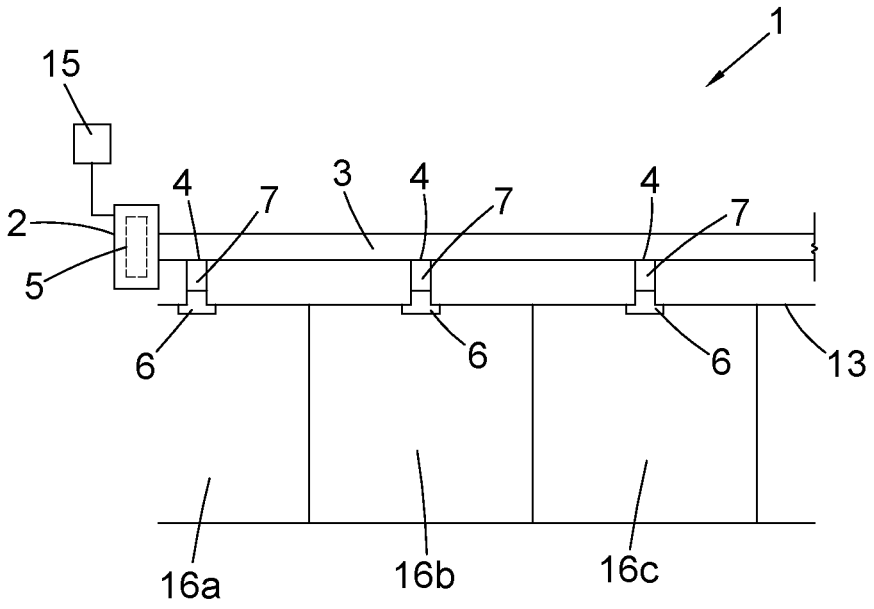
FIG. 1 shows a schematic of an aspiration smoke detection system.

FIG. 1 shows an aspiration smoke detection system 1 capable of detecting the presence of a fire within a region of interest, for instance one or more rooms 16*a*, 16*b*, 16*c* of a building. The system 1 comprises a central detection unit 2 and a sampling pipe 3 extending from the central detection unit 2 for enabling air from the region of interest to be passed to the central detection unit 2. A fan, for example, may be used to draw air into the sampling pipe 3 from the region of interest and pass it to the central detection unit 2. In the exemplary embodiment in FIG. 1, the system 1 is shown located and arranged within a ceiling void above several rooms 16*a*, 16*b*, 16*c* in a building in order to detect smoke emanating from within one or more of the rooms 16*a*, 16*b*, 16*c*. However, the aspiration smoke detection system 1 may be used in any location to detect the presence of a fire in a region of interest.

The central detection unit 2 includes a sampling chamber 5 (shown by the dashed line in FIG. 1) that is fluidly connected to the sampling pipe 3. The sampling chamber 5 houses a smoke detector for detecting the presence of smoke particles suspended in the air within the sampling chamber 5. The smoke detector may for example be a nephelometer, or any other known smoke detector. The central detection unit 2 also includes a controller 15 for controlling operation of the smoke detection system 1 and/or for processing data from the system 1. The controller 15 is connected to the smoke detector such that data acquired by the smoke detector can be passed to the controller 15 for further processing.

The smoke detector is highly sensitive and able to detect the presence of smoke particles suspended in the air within the sampling chamber 5 even when the concentration of smoke particles is low, for example below 0.03% obs/m (0.01% obs/ft) or below 0.015% obs/m (0.005% obs/ft). This means that the smoke detector may be able to detect the existence of slowly developing smouldering fires during the early stages of such fires, e.g. before flames are present.

The sampling pipe 3 has a plurality of inlets 4 along its length to allow air and smoke particles to enter the sampling pipe 3. To enable the system 1 to detect the presence of smoke in each of the rooms 16*a-c* within the region of interest, the inlets 4 are arranged along the sampling pipe 3 such that air and smoke can enter the system 1 from each room 16*a-c* via at least one inlet 4. For example, one, two, a plurality or more inlets 4 may be located in the sampling pipe 3 above each room 16*a-c*. Whilst the present example has a plurality of inlets 4 for detecting the presence of smoke in a plurality of rooms, it will be appreciated that the system 1 may only have one inlet 4, for example where the region of interest includes a single room or other undivided area.

Each of the inlets 4 is fluidly connected to an inlet piece 6 by flexible tubing 7. Whilst in this example flexible tubing 7 is used to fluidly connect an inlet 4 to an inlet piece 6, it will be appreciated that any suitable fluid connection may be used. For example, a rigid fluid connection may be used.

Figure 2:
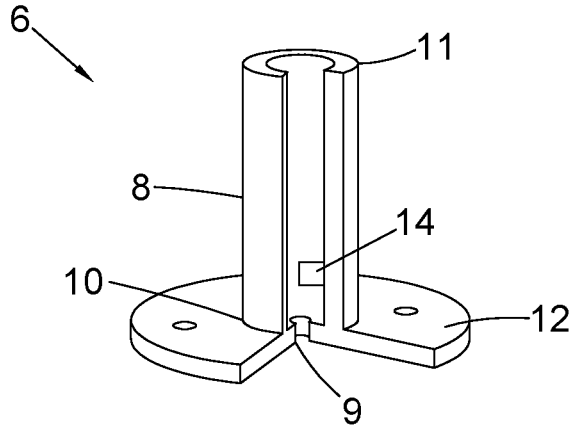
FIG. 2 shows a cross section through an inlet piece that may be used with the aspiration smoke detection system of FIG. 1.

An inlet piece 6 that may be used with the system 1 of FIG. 1 is shown in more detail in FIG. 2. Each inlet piece 6 includes an inlet pipe 8 having a capillary sampling port 9 arranged at a first end 10 of the inlet pipe 8. The sampling port 9 allows air and smoke particles to enter the inlet pipe 8 and subsequently pass to the sampling pipe 3. In this example, a flange 12 is provided at the first end 10 for facilitating mounting of the inlet piece 6 within the region of interest. For example, the inlet piece 6 may be mounted to a ceiling panel 13 of a room 16*a-c* by attaching the flange 12 to the ceiling panel 13. A second end 11 of the inlet pipe 8 is for connection to one of the inlets 4 of the sampling pipe 3 via the flexible tubing 7, thereby fluidly connecting the inlet piece 6 to the sampling pipe 3.

With this arrangement, it is possible for air (and smoke particles when present) within each of the rooms 16*a-c* to be drawn into the sampling pipe 3 by passing consecutively through a sampling port 9, an inlet pipe 8 and a flexible tube 7. The air, along with any smoke particles suspended in the air, is then able to pass (e.g. driven by a fan) via the sampling pipe 3 to the sampling chamber 5 of the central detection unit 2.

As shown in FIG. 2, each inlet piece 6 is provided with a local sensor 14 within the inlet pipe 8 adjacent the sampling port 9. The one or more local sensors 14 may for example be rate-of-rise temperature sensors for monitoring the change of temperature within a room. Rate-of-rise temperature sensors are able to detect rapid increases in temperature that may be indicative of the presence of a fire within a room by measuring the rate at which a sensed temperature rises. The one or more local sensors 14 are connected to the controller 15 of the central detection unit 2 to allow data acquired by the local sensors 14 to be passed to the controller 15 for further processing.

The local sensors 14 are less sensitive than the smoke detector housed in the central detection unit 2. Each of the local sensors 14 may be capable of quickly detecting the presence of a quickly developing, highly exothermic fire in the region of interest that releases a large quantity of heat and/or smoke over a relatively small amount of time. In fact, the local sensors 14 may be able to detect this type of fire before the central detection unit 2 because of the smaller distance between the local sensor 14 and the fire compared to the distance between the central detection unit 2 and the fire.

However, the local sensors 14 may not be able to quickly detect the presence of a slowly developing smouldering fire which initially gives off only a small amount of heat and smoke due to the lesser sensitivity. Instead, the system 1 can rely on the highly sensitive smoke detector within the central detection unit 2 to detect the presence of such a slowly developing fire. The extra time for the slowly developing smouldering fire to be detected because of the longer distance between the central detection unit 2 and the fire is acceptable for such slow developing fires. However, in such a circumstance, when a fire has been detected by the central detection unit 2 but not by the local sensors 14 (and in a system with a plurality of local sensors 14), data from the plurality of local sensors 14 may still be used to determine where the fire is most likely to be located. For example, the data from the local sensors 14 may be analysed to determine whether any of them have shown small changes in the sensed condition that may suggest that local sensor 14 is closest to the fire. This may allow the location of the fire to be determined more quickly even if the local sensors 14 are not sensitive enough to actually detect the fire directly.

Whilst in this example the one or more local sensors 14 are each located in the one or more inlet pieces 6, the one or more local sensors may be in any location remote from the central detection unit 2 that is closer to the region of interest e.g. in a location that allows the local sensor 14 to measure a property of air as it is drawn into the system 1. The fact that the system 1 comprises a central smoke detection unit 2 and one or more local, less sensitive sensors 14 which are closer to the region of interest may be more important than the precise location of the one or more local sensors 14.

The operation of the smoke detection system 1 will now be described with reference to FIGS. 1 and 2.

The presence of a fire or the start of a fire in one or more of the rooms 16*a-c* in the region of interest generates smoke and/or heat. Air (and smoke where present) from each of the rooms 16*a-c* in the region of interest is drawn into the system 1 through the sampling ports 9, e.g. aided by the action of the fan. The air then passes through the corresponding inlet piece 6 and flexible tubing 7 to the sampling pipe 3. In the sampling pipe 3 the air from each of the sampling ports 9 is combined and mixed, and passed to the sampling chamber 5 of the central detection unit 2.

Within the central detection unit 2 (e.g. in the sampling chamber 5 in the central detection unit 2), the smoke detector is used to determine the concentration of smoke particles suspended in the air. The smoke detector constantly monitors the air in the sampling chamber 5 to determine if smoke particles are present. The smoke detector acquires information about the concentration of smoke particles in the air, and this smoke concentration data is passed to the controller 15 for further processing.

The heat generated by the fire (or some other parameter) will also be sensed by one or more of the local sensors 14. Each of the local sensors 14 may constantly or periodically monitor the air from a particular room 16*a-c* and generate data about the air, e.g. the rate at which the temperature changes. The data generated by the local sensors 14 may indicate how the temperature of the rooms 16*a-c* fluctuates over time. This data from the one or more local sensors 14 is also passed to the controller 15 for further processing.

The controller 15 analyses the smoke concentration data and the data acquired respectively by the smoke detector and the local sensors 14 to determine if a fire is present within one or more of the rooms 16*a-c* in the region of interest. If the smoke concentration data indicates that the concentration of smoke particles in the sampled air is above a predefined threshold limit, for example 0.3% obs/m (0.1% obs/ft), the controller 15 determines that a fire is present in one of the rooms 16*a-c* and may trigger an alarm and/or an alert.

In addition, the controller 15 may be able to determine the most likely location of the fire by analysing the data from the local sensors 14. For example, the heat generated by the fire may cause the temperature in one or more of the rooms 16*a-c* to increase. As a result, the data acquired by one or more of the local sensors 14 may be representative of this increase in temperature. That is to say, if the temperature in a room 16*a-c* increases by a certain amount, the data acquired by the local sensor 14 situated in that room 16*a-c* may also deviate. This deviation may be too small for it to be determined that a fire has started but once a fire has been detected by the central detector 2, is sufficient to suggest that local sensor 14 is the one closest to the detected fire. For example, the controller 15 may determine which of the local sensors 14 has the greatest deviation in the sensed data. This local sensor 14 is determined to be the one most likely to be the closest to the fire. Therefore, the controller 15 identifies this local sensor 14 as being located at the most likely location of the fire. Since the locations of the local sensors 14 are known, the controller 15 is able to identify the most likely location of the fire. This may help speed up the location determination of a fire which has been detected using an aspiration smoke detection system 1, particularly a system 1 that monitors a large region of interest.

The system 1 may also able to detect the presence of a fire based on the data acquired by the local sensors 14.

If one of the local sensors 14 senses a change in the sensed data that is above a predefined threshold, the controller 15 determines that a fire is present at the location of the particular local sensor 14 and raises an alarm and/or alert. For example, if the local sensors 14 comprise temperature sensors, if one of the local sensors 14 senses a rate of increase in temperature that is above a predefined threshold, for example above 6° K./minute or above 8° K./minute, the controller 15 may determine that a fire is present at the location of the particular local sensor 14 and may raise an alarm and/or alert.

The combination of the highly sensitive smoke detector housed in the sampling chamber 5 and the less sensitive local sensors 14 allows the system 1 to be able to quickly detect and alert people to the presence of different types of fires and also allows the system to identify a likely location of these fires within the region of interest. As discussed above, slowly developing smouldering fires initially generate low levels of heat and smoke. The local sensors 14 may not be sensitive enough to detect the presence of such a fire, at least initially, and the fire is instead detected by the central smoke detector due to the increased concentration of smoke particles suspended in the air passed to the central detection unit 2.

The presence of quickly developing exothermic fires, e.g. flaming polyurethane, may be detected quickly by the local sensors 14 due to the large, fast change in parameters, e.g. rapid increase in temperature, caused by such fires. Since the system 1 can identify the presence of quickly developing exothermic fires without the need for air to be passed to the sampling chamber 5, the time taken by the system 1 to detect such fires is not limited by the transportation time and hence may be quicker than the transportation time.

Moreover, the presence of the local sensors 14 also enables the system 1 to indicate the location of a fire within the region of interest. In the case of a slowly developing smouldering fire, whilst the local sensors 14 may not be able to determine the presence of such a fire, if the fire is close to a local sensor 14 it may cause the local sensor 14 to register a variation in data, e.g. increase in temperature. This data is used by the controller 15 to determine the most likely location of the fire detected by the central smoke detector 2.

The local sensors 14 also provide the system 1 with information about the location of quickly developing exothermic fires that are detected by one or more of the local sensors 14.

Hence, the aspiration smoke detection system 1 ensures that quickly developing exothermic fires as well as slowly developing smouldering fires can be detected quickly to meet safety certification standards. The aspiration smoke detection system 1 may also ensure that the location of a fire, the presence of which is detected by the system 1, can be identified quickly.

What is claimed is:

1. An aspiration smoke detection system for detecting the presence of a fire within a region of interest, the aspiration smoke detection system comprising:

a smoke detection unit comprising a smoke detector housed within a sampling chamber for detecting the presence of smoke particles suspended in air within the sampling chamber; and one or more local sensors located remotely from the smoke detection unit for measuring a property of air from the region of interest that is drawn into the aspiration smoke detection system;

wherein the aspiration smoke detection system is configured to pass air from the region of interest to the sampling chamber of the smoke detection unit via one of the one or more local sensors, and wherein the aspiration smoke detection system is configured to use the one or more local sensors to detect quick developing fires before a sample of air reaches the sampling chamber of the smoke detection unit.

2. An aspiration smoke detection system according to claim 1, wherein the smoke detection unit is more sensitive than the one or more local sensors.

3. An aspiration smoke detection system according to claim 1, wherein the local sensor is for measuring one or more of: the rate of temperature change of the air, the presence of smoke particles suspended in the air, and the presence of carbon dioxide in the air.

4. An aspiration smoke detection system according to claim 1, wherein the system comprises a controller, wherein the controller is arranged to receive data collected by the smoke detection unit and the one or more local sensors.

5. An aspiration smoke detection system according to claim 4, wherein the controller is configured to raise an alarm if the concentration of smoke particles suspended in the air measured by the smoke detection unit is above a predetermined threshold value.

6. An aspiration smoke detection system according to claim 4, wherein the controller is configured to raise an alarm if data from one or more of the local sensors measures a property of the air that is indicative of a fire.

7. An aspiration smoke detection system according to claim 4, wherein if the data from the smoke detection unit is indicative of a fire being present in the region of interest, the controller is configured to determine the most likely location of a fire within the region of interest based on data collected by the local sensors.

8. An aspiration smoke detection system according to claim 1, wherein the local sensors are configured to continuously monitor the air drawn into the aspiration smoke detection system from the region of interest.

9. An aspiration smoke detection system according to claim 1, wherein the local sensors are configured to periodically monitor the air drawn into the aspiration smoke detection system from the region of interest.

10. An aspiration smoke detection system according to claim 1, comprising one or more inlets for passing air from the region of interest into the smoke detection unit.

11. An aspiration smoke detection system according to claim 10, wherein the one or more local sensors are each located on, near or in one of the inlets.

12. An aspiration smoke detection system according to claim 10, wherein the transport time of air from at least one of the inlets to the smoke detection unit is greater than 70 seconds, or greater than 100 seconds.

13. An aspiration smoke detection system according to claim 10, wherein the distance a sample has to travel between one or more of the inlets and the smoke detection unit is greater than 50 m, or greater than 100 m, or greater than 200 m.

14. A method of detecting a fire within a region of interest using an aspiration smoke detection system, the method comprising:

providing the aspiration smoke detection system of claim 1;

passing air from the region of interest to the sampling chamber of the smoke detection unit via one of the one or more local sensors;

using the smoke detector of the smoke detection unit to measure a concentration of smoke particles within the air that has been passed to the sampling chamber of the smoke detection unit;

using the one or more local sensors to measure a property of the air that can be used to indicate the presence of a fire;

determining if the concentration of smoke particles measured by the smoke detector of the smoke detection unit is indicative of a fire within the region of interest; and/or determining if the measured property of air sensed by the one or more local sensors is indicative of a fire within the region of interest;

wherein the local sensors are used to measure a property of the air before the air reaches the sampling chamber of the smoke detection unit in order to detect quick developing fires before the air reaches the smoke detection unit.

15. A method according to claim 14, wherein the local sensors are used to continuously monitor the air drawn into the aspiration smoke detection system from the region of interest.

16. A method according to claim 14, wherein the local sensors are used to periodically monitor the air drawn into the aspiration smoke detection system from the region of interest.

17. A method according to claim 14, wherein the transport time for the air from at least one of the local sensors to the smoke detection unit is greater than 70 seconds, or greater than 100 seconds.

18. A method of detecting a fire within a region of interest using an aspiration smoke detection system, wherein the aspiration smoke detection system is the aspiration smoke detection system of claim 1.

19. A method of retrofitting one or more local sensors to an existing aspiration smoke detection system to provide the aspiration smoke detection system of claim 1.

* * * * *